United States Patent [19]

Davies

[11] Patent Number: 5,043,530

[45] Date of Patent: Aug. 27, 1991

[54] ELECTRICAL CABLE

[75] Inventor: William E. Davies, Highgate Center, Vt.

[73] Assignee: Champlain Cable Corporation, Winooski, Vt.

[21] Appl. No.: 388,102

[22] Filed: Jul. 31, 1989

[51] Int. Cl.[5] ..... H01B 7/18

[52] U.S. Cl. ..... 174/36; 174/102 R; 174/113 R; 174/116

[58] Field of Search ..... 174/143 R, 116, 36, 174/102 R

[56] References Cited

U.S. PATENT DOCUMENTS

| | | | |
|---|---|---|---|
| 1,698,704 | 1/1929 | Middleton et al. | 174/113 R |
| 3,485,939 | 12/1969 | Brown et al. | 174/113 R |
| 3,576,388 | 4/1971 | Bruns | 174/113 R |
| 4,319,940 | 3/1982 | Arroyo et al. | 174/110 N |
| 4,626,810 | 12/1986 | Nixon | 174/110 FC X |
| 4,642,417 | 2/1987 | Ruthrof et al. | 174/36 |
| 4,658,089 | 4/1987 | Guzy et al. | 174/113 R |

FOREIGN PATENT DOCUMENTS

| | | | |
|---|---|---|---|
| 403371 | 12/1933 | United Kingdom | 174/116 |
| 470862 | 8/1937 | United Kingdom | 174/116 |
| 625613 | 6/1949 | United Kingdom | 174/113 R |

*Primary Examiner*—Morris H. Nimmo

*Attorney, Agent, or Firm*—Salzman & Levy

[57] ABSTRACT

The invention features a shielded cable that has reduced susceptibility to system generated electromagnetic pulse effects. A two-part silicone rubber compound introduced to the conductive core and shield of the cable fills in all the voids and spaces between the wire leads and the shield braided strands, thus eliminating the deleterious pulse effect susceptibility.

30 Claims, 3 Drawing Sheets

FIG-1
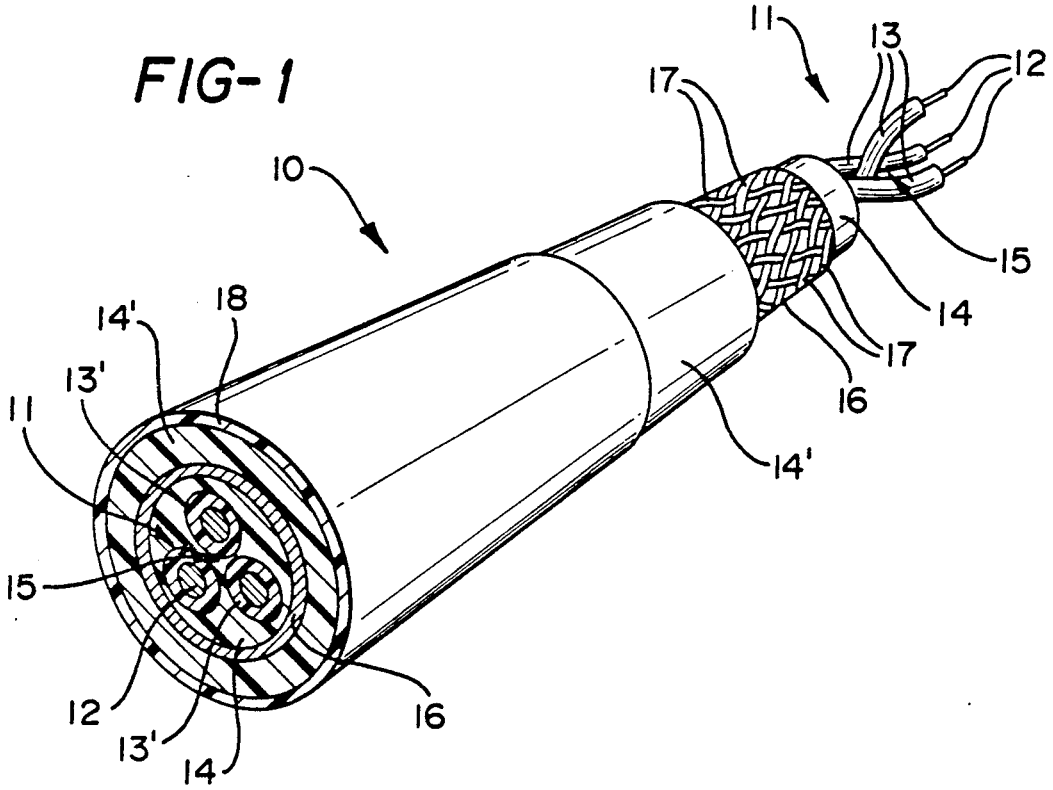
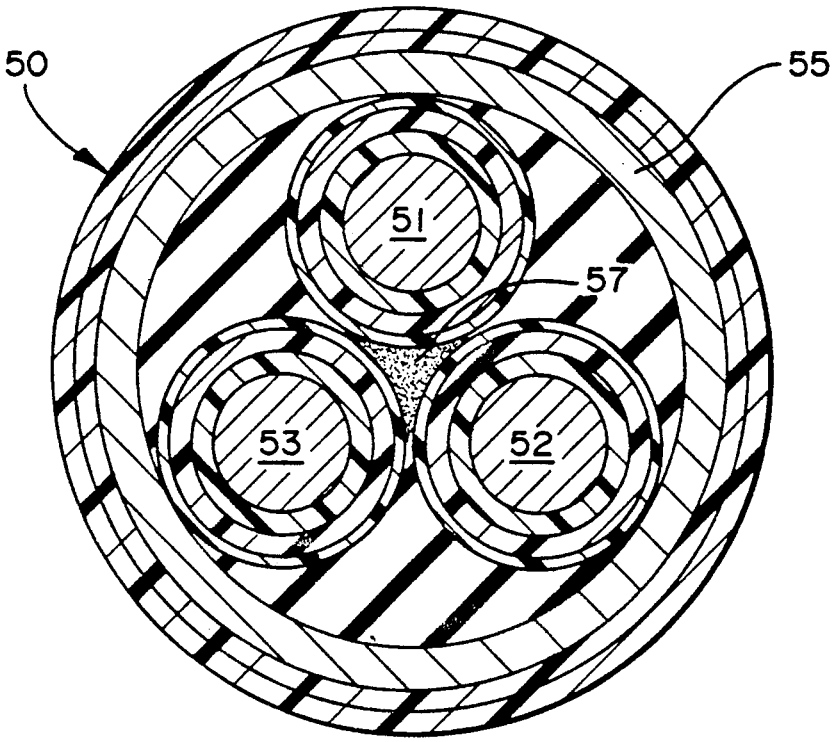
FIG-5
PRIOR ART

ELECTRICAL CABLE

FIELD OF THE INVENTION

The invention features an improved electrical cable for use in critical electronic applications wherein system generated electromagnetic pulses cannot be tolerated.

BACKGROUND OF THE INVENTION

The fabrication of electrical cables is becoming more sophisticated as specialized electrical requirements are becoming more commonplace. One of the specialized requirements includes the need for a shielded electrical cable having a reduced system generated electromagnetic pulse effect. This pulse effect is significantly amplified in cabling containing internal voids. Such voids are particularly noticeable in cabling containing braided shielding, whose interleaved checkerboard pattern provides wide internal gaps after a surrounding insulative jacket is applied.

In order to fill these gaps, a silicone rubber gum was extruded around and between the lead wires prior to applying the braided shielding. However, the pulse effect was not eliminated because a number of internal spaces were still present with this fabrication method.

The invention resolved the problem by applying a two-part silicone rubber material comprising a rubber base and catalyst under pressure to the extrusion cavity. The two-part system had sufficient viscosity and thixotropic properties, including an acceptable curing time, such that it could be introduced under sufficient pressure in order to fill all of the internal voids between the wire leads and in the shield spaces. The resultant cable product was substantially free of all internal voids, thus greatly reducing system generated electromagnetic pulse effects therein.

SUMMARY OF THE INVENTION

An electrical cable having a reduced susceptibility to system generated electromagnetic pulse effects comprises an internal conductive core featuring between one and four wire leads. The wire leads are each insulated by crosswrapping them with polyimide tape and dip-coating in polyimide. Other insulative materials can be used such as fluoropolymers (e.g., PTFE, FEP, ETFE, ECTFE, etc.). They are cabled and then fed to an extrusion cavity where an amorphous, uncured, elastomeric material is introduced under pressure in an excess quantity. The amorphous, elastomer fills the voids between the wire leads.

On passing from the cavity, strands of silvered copper alloy are braided over the elastomer-covered conductive core to provide a shield layer. Other wire materials can be used such as bare copper, tin-coated copper, silver-plated copper, nickel-plated copper or aluminum. The strands of the shield become embedded in the elastomeric material, which fills all the spaces in the braided structure.

The shielded core is then fed to a wiping die where the excess elastomer is removed, leaving a thin layer of the elastomer remaining on the surface.

A polyimide jacket is then applied by a number of tape wrapping heads. It is also possible to use a barrier tape of polymide, polyester or fluorocarbon polymer material over which an extruded jacket is applied after the elastomer cures.

The fabricated cable now comprises a conductive core surrounded by a braided shield, with elastomeric material disposed between and through the wire leads and the braided shield. The insulative jacket surrounds the elastomer covered shield and conductive core.

The elastomer is now allowed to cure for approximately 8 to 24 hours.

The elastomeric material comprises a two-part silicone rubber compound consisting of equal parts of a silicone rubber base and a catalyst. The silicone rubber has a viscosity in the uncured state of between 1.2 and $3.2\times10^6$ centipoises. The silicone rubber compound is thixotropic, which allows it to flow easily under pressure.

After curing, the jacket of the cable is fused in a hot air oven. In the case when an extruded jacket is applied, no hot air curing is required.

Substantially all the voids are removed from the shielded cable, thus reducing the system generated electromagnetic pulse effects.

It is an object of invention to provide an improved electrical cable for critical electronic applications.

It is another object of the invention to provide a shielded electrical cable that is substantially free of internal voids.

BRIEF DESCRIPTION OF THE DRAWINGS

These and other objects of this invention will become apparent and will be better understood with reference to the following detailed description considered in conjunction with the accompanying drawings, in which:

FIG. 1 is a perspective view of a shielded cable fabricated in accordance with the invention;

FIG. 5 depicts a cross-sectional schematic view of a prior art construction of a cable shield filled with a gummed silicone rubber which did not adequately fill the voids in the braided strands of the shield.

DESCRIPTION OF THE PREFERRED EMBODIMENT

Figure 2:
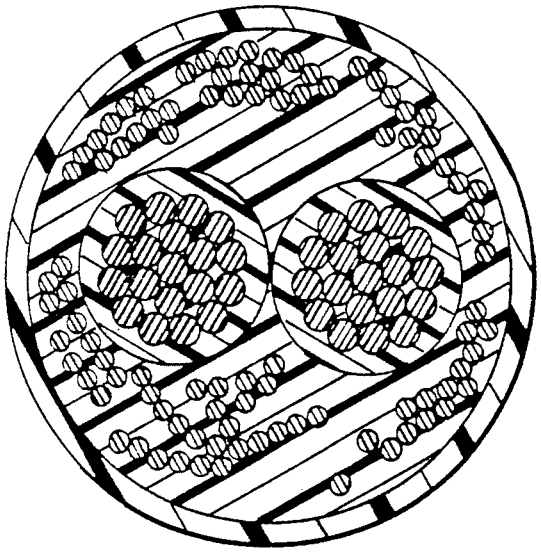
FIGS. 2, 3 and 4 are cross-sectional photographic views of shielded cables made in accordance with the invention, illustrating conductive cores containing two, three and four wire leads, respectively.

Generally speaking the invention relates to a shielded cable fabricated with substantially no internal voids, wherein the cable has a reduced system generated electromagnetic pulse effect.

Like elements will be labelled with the same designation throughout the figures for the sake of clarity.

Now referring to FIG. 1, a cable 10 is illustrated, which has been fabricated in accordance with the invention.

The cable comprises an inner conductive core 11 consisting of between one and four wire leads 12 (three shown), that are covered by a layer of polyimide insulation 13. The wire leads 12 are comprised of silver-coated copper.

An elastomeric, amorphous material 14, such as a silicone rubber compound, is introduced under pressure, in and between the insulated leads filling centrally-located voids 15. The voids 15 form between the cylindrically curved surfaces of the wire leads, as they are twisted and cabled about each other.

A thick layer of the silicone rubber compound is disposed about the wire leads, such that when a shield 16 is braided over the amorphous material 14, the rubber compound will invade the checkerboard spaces 17 of the shield filling these voids.

The braided shield 16 is comprised of interleaved strands of silver-coated copper alloy.

The material 14 is applied in sufficient excess to provide a second, outer layer 14' that completely encapsulates the shield 16, as illustrated.

A final insulating jacket 18 of polyimide tape is wrapped about the outer elastomeric, amorphous layer 14'.

Referring to FIG. 7, a schematic diagram of the fabrication system 20 for making the cable 10 of FIG. 1 is shown.

The fabrication system 20 comprises feeding a silicone rubber compound to an extrusion cavity 21 therethrough which a conductive core 11 is caused to pass, arrow 22. The conductive core 11 is fed from a payoff spool 23 to the extrusion cavity 21, which receives the silicone rubber compound from conduit 24.

The core 11 is comprised of cabled insulated wire leads 12, 13 illustrated in FIG. 1.

The lead wire 12 is insulated according to specification MIL-W-81381/17 and /19, with two crosswrapped polyimide tapes. That is, layer 13 includes duPont Kapton HF, and a dip coat of liquid polyimide, i.e., duPont Pyre ML Wire Enamel (Liquid H-301). The lead wire 12 is cabled for multi-conductor constructions, shielded (layer 16) and jacketed (layer 18) with two crosswrapped duPont Kapton HF polyimide tapes. Other polymer materials are also available for this purpose.

The internal spaces 15 between leads are filled in cavity 21 with a silicone rubber cable valley sealant produced by Polysar Inc., Akron, Ohio. It is a two part mixture of SE 4204U base material and SE 4224C catalyst in a 1:1 ratio.

The base material, SE 4204U, is fed to a static mixer 25, such as that manufactured by Graco, Inc., via conduit 26.

The catalyst component SE 4224C is fed to the static mixer 25 through conduit 27.

The two-part compound is mixed in equal proportions by pumping each material to the static mixer 25. From there, the two-part compound is fed to separate cable manufacturing machines (Nos. 1 and 2) via lines 24 and 34, respectively. Only conduit 24 (machine No. 1) is described, because both machines are identically constructed. The pressure in feed lines 26 and 27, as well as the differential pressure between feed lines 26 and 27, is continuously monitored by pressure gauges 36, 37 and 38, respectively.

The pressures are carefully recorded by data recorder 39 to provide a record that each component is properly mixed in the desired ratio. The pressure controls the flow rate or volume of the materials introduced to mixer 25.

Likewise, the pressure in the cavity 21 is carefully monitored by gauge 28. A minimum of between 300 to 400 psi is required. The sensed pressure in cavity 21 is also recorded by data recorder 39. The controller 28 operates the motorized valve 40 that regulates the flow to cavity 21.

Cavity 21 has a exit die orifice 30 that controls and maintains the amount of excess (layers 14 and 14') material being coated over conductive core 11.

As the coated wire passes from (arrow 32) orifice 30, a shield 16 is braid wrapped about the excessively coated wire at station 31.

The thickness of the outer elastomeric layer 14' is controlled by wiping die 35, as the braided cable moves therethrough (arrow 33).

The outer layer 14' is then jacket encapsulated by polyimide wraps provided by tape heads 41.

The jacketed cable 18 is then wound upon a take-up roll 45.

The silicone rubber compound will cure and harden in approximately 8 to 24 hours at ambient temperature.

Once the silicone rubber is cured, the jacket 18 can be fused in a hot air oven, not shown.

Braiding, as the name implies, is a process of applying a stranded material, metallic wire in this case, over the central core 11. One-half of the strands are rotated clockwise, the other half counter-clockwise and the machine causes them to be alternately laid over and under strands rotating in the opposite direction. The end result is a construction like a child's "Chinese Finger Trap". The inventive fabricating process applies an excessive quantity of silicone rubber, under pressure, to the central conductors. The braid is then embedded in the excess, which fills all of the spaces 17 in the shield 16. The tight fitting rubber die 35 wipes off the excess and leaves a thin film of rubber (layer 14') on the surface.

Figure 3:
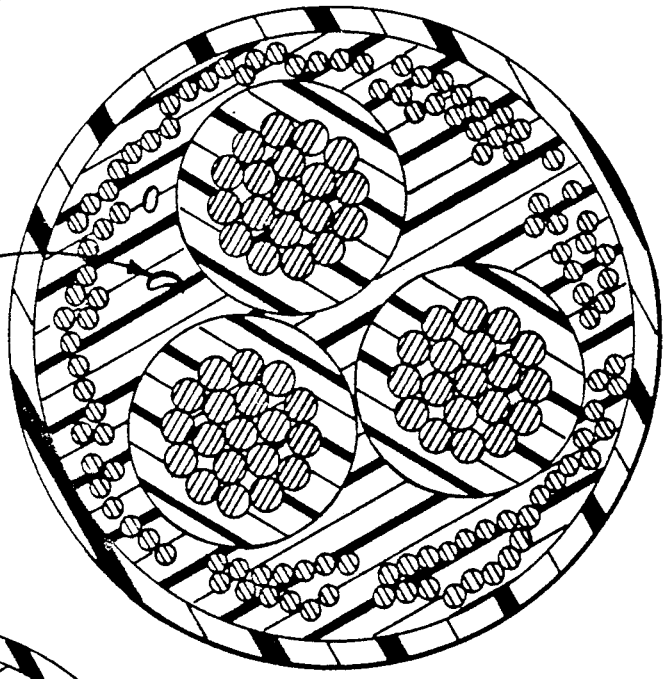
Figure 4:
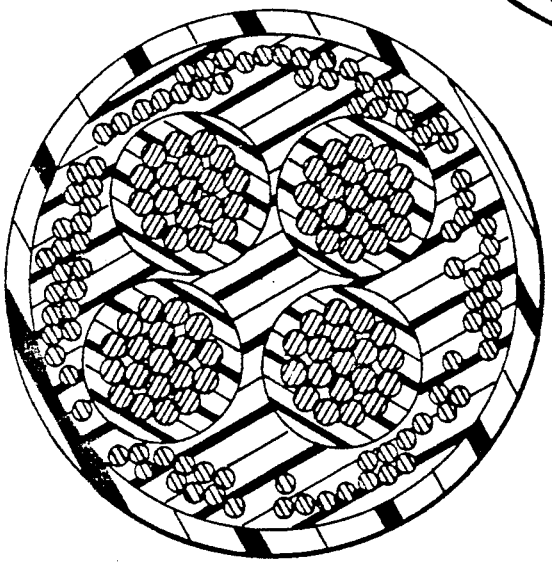
Figure 6:
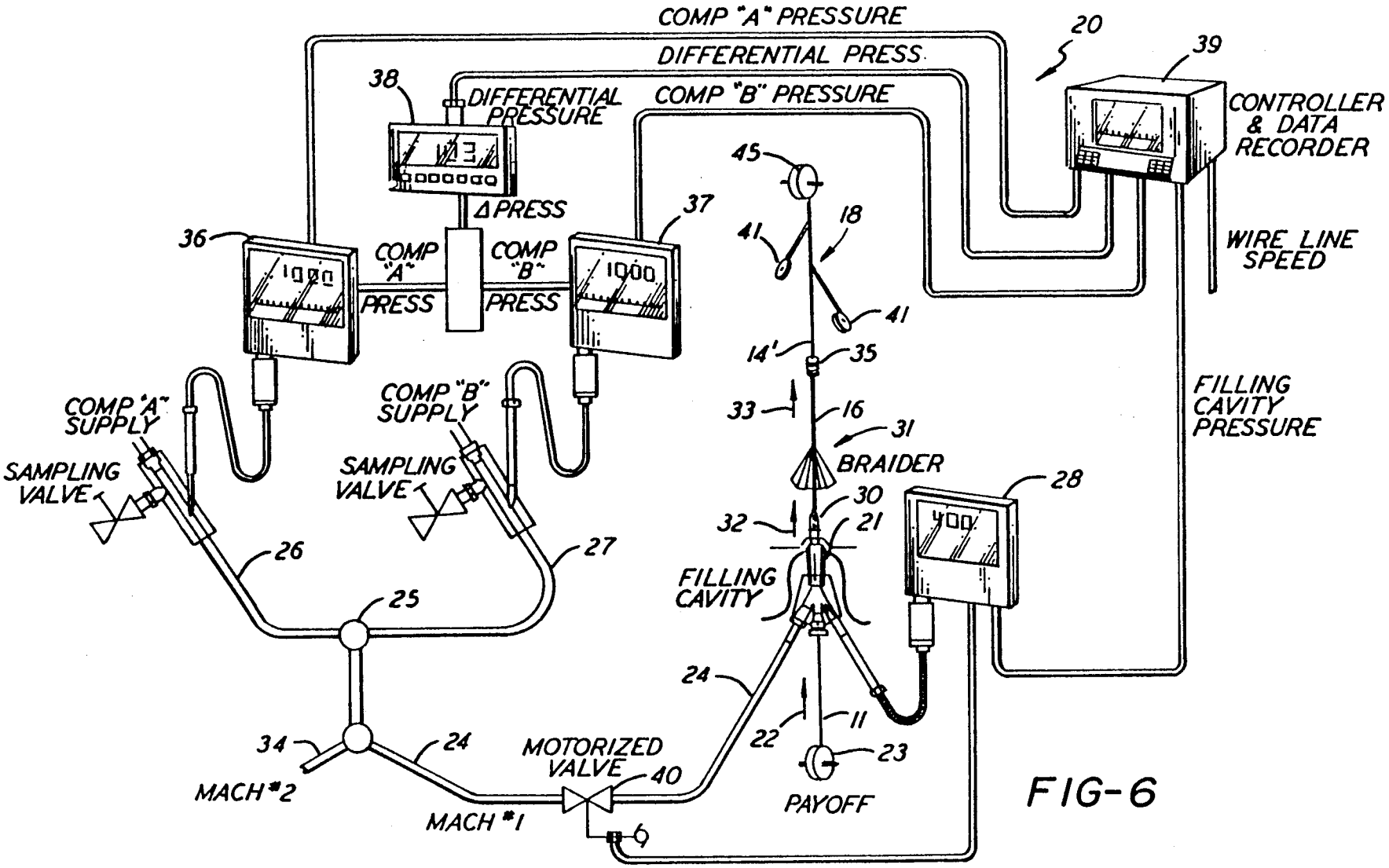
FIG. 6 illustrates a schematic diagram of the cable fabricating system of the invention.

Referring to the photographic sectional views of FIGS. 2, 3 and 4, typical two-wire, three-wire, and four-wire constructions are shown for the cable made by the inventive fabricating system of FIG. 7.

It will be evident from these photographs that the silicone rubber compound fills in all the voids between the wire leads and the spaces 17 in the braided shield 16.

This filling-in process is accomplished by virtue of the thixotropic nature of the silicone rubber compound and its workable viscosity in the range of 1.2 to $3.2\times10^6$ centipoises. These desirable characteristics allow the amorphous material to flow easily under pressure, thus filling-in all the available voids and spaces within the cable, and prevents the material from flowing back out of the cable before the jacket tapes are applied.

When these spaces and voids are plugged, the cable becomes less susceptible to system generated electromagnetic pulses. Susceptibility to such electromagnetic pulses is a characteristic that is highly detrimental in certain critical electronic applications.

As can be observed in FIG. 3, the filling process will occasionally produce small voids that may result from entrained or trapped air. These small voids are not critical in preventing the electromagnetic pulse effect.

FIG. 5 depicts a schematic view of a shielded core 50 of the prior art that wa filled by the previous silicone rubber gum process. The prior art silicone rubber gum process left large voids in the checkered braiding 55 and between the insulated wire leads 51, 52, 53. The centrally located voids 57 were especially prominent in the prior art shielded core 50.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented by the subsequently appended claims.

What is claimed is:

1. An electrical cable having a reduced susceptibility to system generated electromagnetic pulse effects, comprising:

an insulated conductive wire core comprising at least one wire lead;

a shield layer surrounding said conductive wire core;

an insulative jacket surrounding said shield layer; and a cured, integrally formed, elastomeric, amorphous material mass disposed about said conductive wire core and substantially filling interstitial voids within said shield layer and between wire leads of said conductive wire core, whereby susceptibility to system generated electromagnetic pulses is substantially reduced.

2. The electrical cable of claim 1, wherein said elastomeric, amorphous material comprises silicone rubber.

3. The electrical cable of claim 2, wherein said silicone rubber in its liquified state is characterized by a viscosity in an uncured state in an approximate range of between 1.2 to $3.2\times10^6$ centipoises.

4. The electrical cable of claim 3, wherein said silicone rubber in an uncured, liquified state is curable within approximately between 8 to 24 hours at ambient temperature.

5. The electrical cable of claim 2, wherein said silicone rubber is defined by a thixotropic paste in an uncured, liquified state.

6. The electrical cable of claim 2, wherein said silicone rubber in an uncured, liquified state is curable within approximately between 8 to 24 hours at ambient temperature.

7. An electrical cable having a reduced susceptibility to system generated electromagnetic pulse effects, comprising:

an insulated conductive wire core comprising at least one wire lead;

a shield layer surrounding said conductive wire core;

an insulative jacket surrounding said shield layer; and a cured, integrally formed elastomeric, amorphous material comprising silicone rubber whose viscosity in its liquified, uncured state is in an approximate range of between 1.2 to $3.2\times10^6$ centipoises, sufficient to allow it to flow under pressure about and within said wire core, wherein said cured silicone rubber becomes disposed about and integrally disposed within interstitial voids of said conductive wire core, and is further characterized by substantially filling voids within said shield layer and between wire leads, whereby susceptibility to system generated electromagnetic pulses is substantially reduced.

8. The electrical cable of claim 7, wherein said conductive wire core contains between one and four wire leads.

9. The electrical cable of claim 8, wherein each of said wire leads is insulated with a material selected from a group consisting of: fluoropolymers.

10. The electrical cable of claim 8, wherein a material insulating said wire leads comprises dip-coated cross-wrapped tapes.

11. The electrical cable of claim 8, wherein each wire lead comprises silver-coated copper.

12. The electrical cable of claim 11, wherein said conductive wire core contains between one and four cabled wire leads.

13. The electrical cable of claim 7, wherein said shield layer comprises braided strands, silver-coated, copper alloy.

14. The electrical cable of claim 7, wherein said insulative jacket comprises a material selected from a group consisting of: a polyester, fluorocarbon and a polyimide.

15. The electrical cable of claim 14, wherein the selected material is a polyimide, and said polyimide insulative jacket comprises a wrap of polyimide tape.

16. The electrical cable of claim 7, wherein said elastomeric, amorphous material is defined by a thixotropic paste in an uncured, liquified state.

17. In an electrical cable including an insulated conductive wire core surrounded by a shield that is further surrounded by an insulative jacket, the improvement comprising:

a cured, integrally formed, elastomeric, amorphous material mass disposed about and within said conductive core and said shield that substantially fills interstitial voids within said shield and within said conductive wire core, and between wires of said conductive wire core, whereby susceptibility to system generated electromagnetic pulses is substantially reduced.

18. The electrical cable of claim 17, wherein said elastomeric, amorphous material comprises silicone rubber.

19. The electrical cable of claim 18, wherein said silicone rubber is characterized in a liquified, uncured state by a viscosity in an approximate range of between 1.2 to $3.2\times10^6$ centipoises.

20. The electrical cable of claim 18, wherein said silicone rubber is defined in a liquified, uncured state by a thixotropic paste.

21. The electrical cable of claim 18, wherein said silicone rubber in a liquified, uncured state is curable within approximately between 8 to 24 hours at ambient temperature.

22. The electrical cable of claim 19, wherein said silicone rubber in a liquified, uncured state is curable within approximately between 8 to 24 hours at ambient temperature.

23. The electrical cable of claim 17, wherein said conductive wire core contains between one and four wire leads.

24. The electrical cable of claim 23, wherein each of said wire leads is insulated with a material selected from a group consisting of: a fluoropolymer and a polyimide.

25. The electrical cable of claim 24, wherein said selected material is polyimide, said polyimide insulation comprises dip coa ed crosswrapped tapes.

26. The electrical cable of claim 23, wherein each wire lead comprises silver-coated copper.

27. The electrical cable of claim 17, wherein said shield comprises braided strands, silver-coated, copper alloy.

28. The electrical cable of claim 17, wherein said insulative jacket comprises a material selected from a group consisting of: a polyester, fluorocarbon and polyimide.

29. The electrical cable of claim 28, wherein said selected material is polyimide, said polyimide insulative jacket comprises a wrap of polyimide tape.

30. The electrical cable of claim 17, wherein said elastomeric, amorphous material is defined in a liquified, uncured state by a thixotropic paste.

* * * * *